US006742228B1

(12) United States Patent
Kim

(10) Patent No.: US 6,742,228 B1
(45) Date of Patent: Jun. 1, 2004

(54) HANGER HAVING CLAMP WITH PAD

(76) Inventor: Young Chang Kim, 104-1303, World 1-cha, Apt. 604 Gyoha-eup, Paju-shi, Kyonggi-do (KR)

( * ) Notice: Subject to any disclaimer, the term of this patent is extended or adjusted under 35 U.S.C. 154(b) by 0 days.

(21) Appl. No.: 09/715,271

(22) Filed: Nov. 17, 2000

(51) Int. Cl.[7] ..... A47G 25/48

(52) U.S. Cl. ..... 24/507; 24/DIG. 29; 24/338; 24/499

(58) Field of Search ..... 24/507, 508, 511, 24/512, 455, 327, 331, 333, 338, 499, DIG. 29

(56) References Cited

U.S. PATENT DOCUMENTS

| | | | | | |
|---|---|---|---|---|---|
| 685,974 | A | * | 11/1901 | Cote | 24/84 |
| 1,689,070 | A | * | 10/1928 | Elliot | 24/84 |
| 2,197,310 | A | * | 4/1940 | Lincoln | 27/23 |
| 2,209,697 | A | * | 7/1940 | Kislingbury et al. | 24/84 |
| 4,192,441 | A | * | 3/1980 | Batts | 223/96 |
| 4,231,500 | A | * | 11/1980 | Mainetti | 223/96 |
| 4,660,750 | A | * | 4/1987 | Blanchard | 223/91 |
| 4,813,107 | A | * | 3/1989 | Cetrone | 24/557 |
| 4,884,727 | A | * | 12/1989 | Blanchard | 223/93 |
| 4,986,752 | A | * | 1/1991 | Graves | 433/138 |
| 5,183,191 | A | * | 2/1993 | Garrison et al. | 223/96 |
| 5,226,846 | A | * | 7/1993 | Onori | 446/404 |
| 5,277,345 | A | * | 1/1994 | Ozaki | 223/98 |
| 5,398,854 | A | * | 3/1995 | Blanchard | 223/96 |
| 5,516,014 | A | * | 5/1996 | Garrison | 223/96 |
| 5,890,634 | A | * | 4/1999 | Zuckerman et al. | 223/96 |
| 5,915,605 | A | * | 6/1999 | Blanchard | 223/96 |
| 5,934,525 | A | * | 8/1999 | Blanchard | 223/96 |
| 6,173,872 | B1 | * | 1/2001 | Cohen | 223/96 |
| 6,263,703 | B1 | * | 7/2001 | Kenney | 63/14.1 |

* cited by examiner

*Primary Examiner*—Anthony Knight
*Assistant Examiner*—André L. Jackson
(74) *Attorney, Agent, or Firm*—Schmeiser, Olsen & Watts

(57) ABSTRACT

A clamp pad-body assembly that resists a separation of the clamp pad from the clamp body due to externally applied forces. The clamp body has a peripheral surface that has a height that is greater than the height of the exterior perimeter surface of the pad, and the exterior perimeter surface of the pad abuts the perimeter surface of a recess in the clamp body. The clamp pad-body assembly my be incorporated into a clothes hanger including two such clamps disposed at the ends of a beam coupled to a question-mark-shaped hook.

19 Claims, 10 Drawing Sheets section A–A section B-B

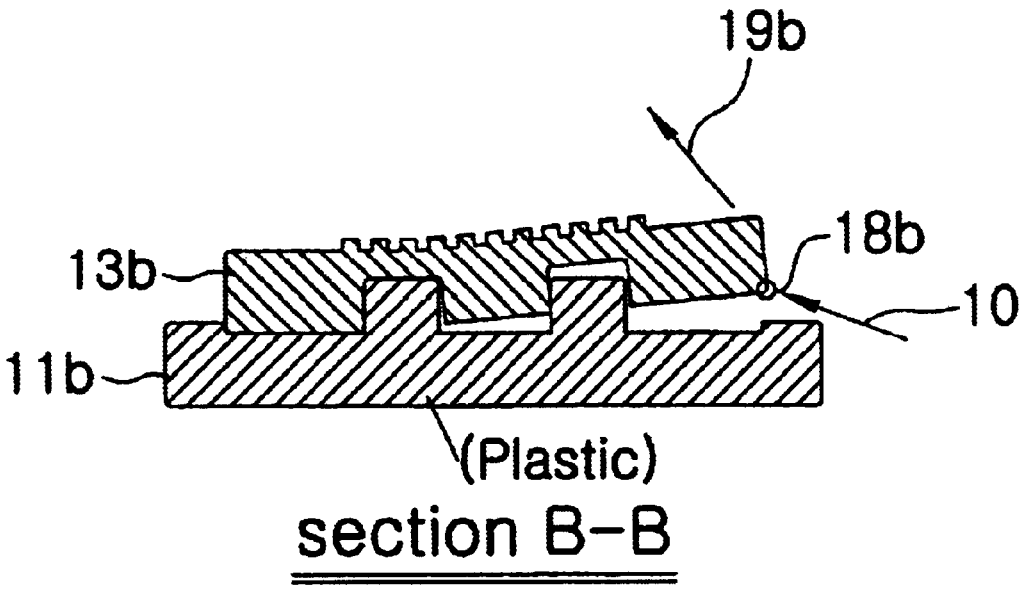
Fig. 1bii Related Art
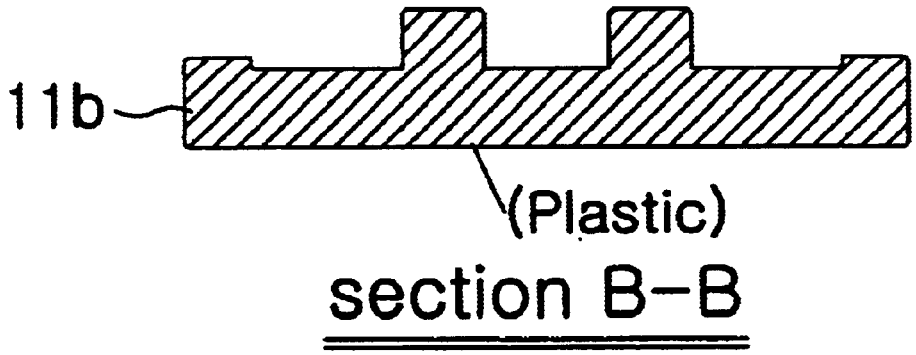
Fig. 1biii Related Art

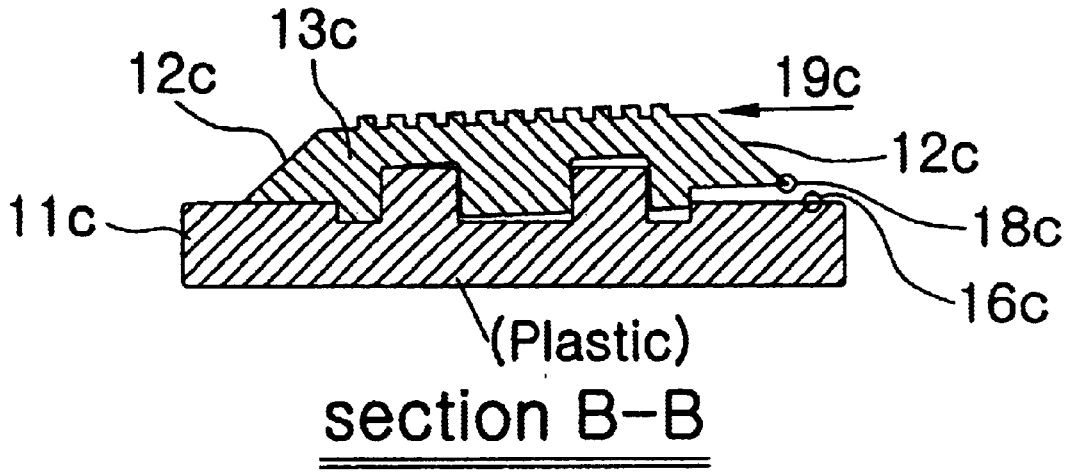
Fig. 1ci Related Art
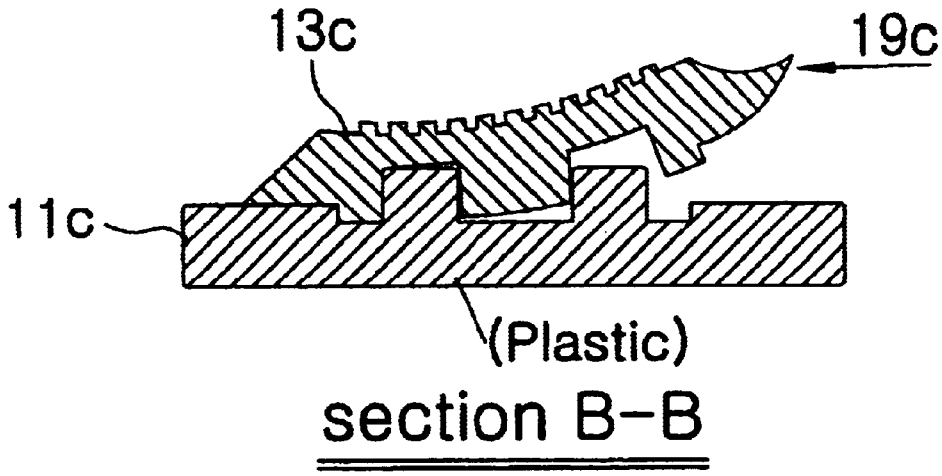
Fig. 1cii Related Art section B-B

Fig. 1ciii Related Art

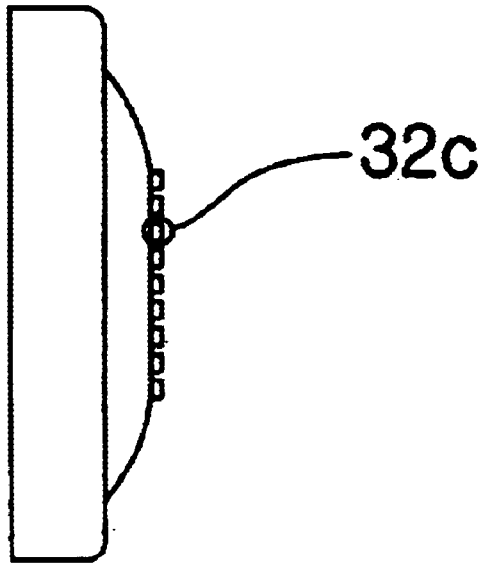
Fig. 3aii
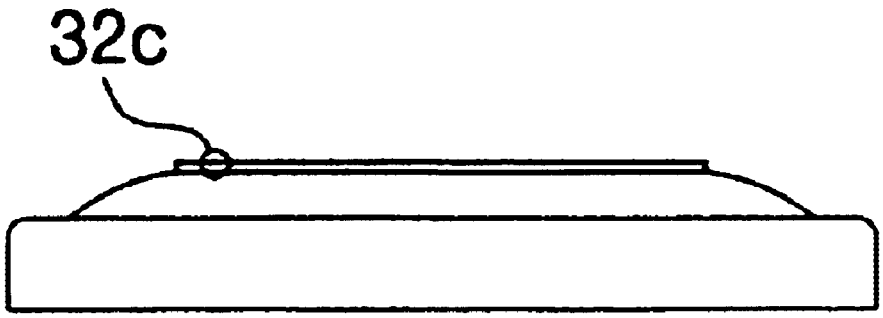
Fig. 3aiii section A–A section B–B

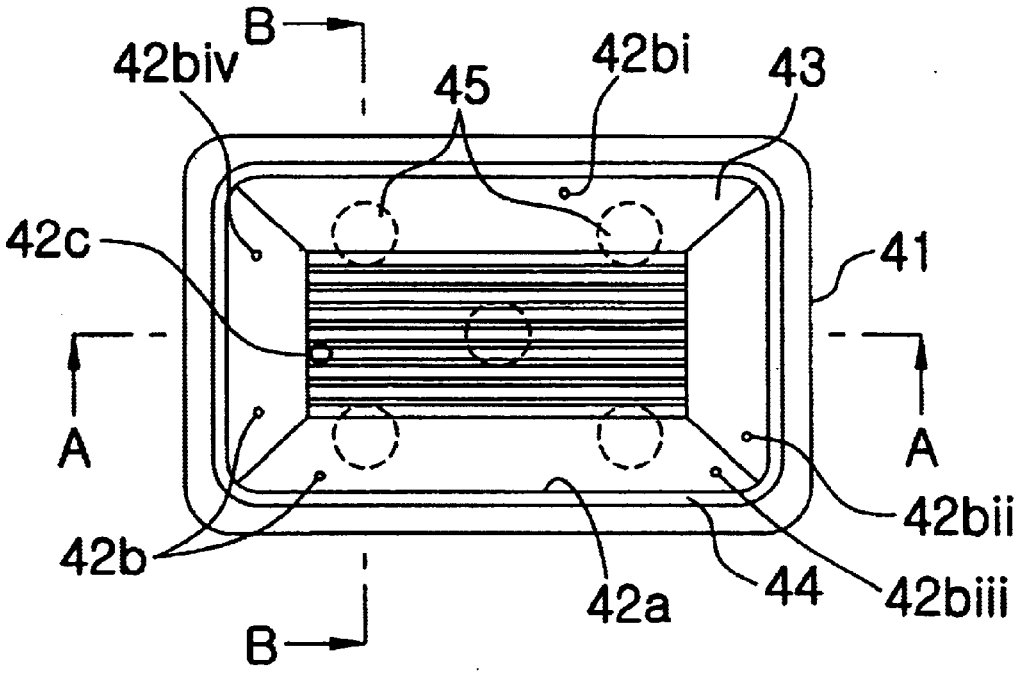
Fig. 4ai
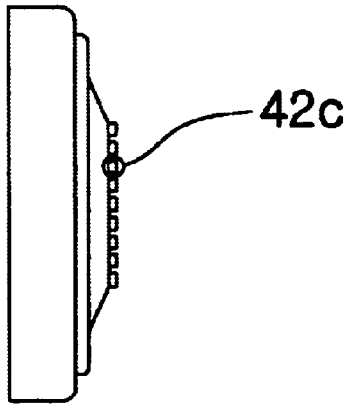
Fig. 4aii

Fig. 4aiii section A–A section B–B

HANGER HAVING CLAMP WITH PAD

BACKGROUND OF THE INVENTION

1. Technical Field

The present invention relates generally to a structure for a hanger, and more specifically, to a hanger having a pad coupled to a clamp body.

2. Related Art

As is well known, clothes hangers are useful for storing, transporting, and drying clothes that are hung from them. Problems with hangers having hard clamp plates to pinch and hold clothing include that they can crush, wrinkle, weaken, or tear the fabric pinched between them, and often can not grip and hold clothes as well as soft gripping materials such as the tips of human fingers.

The related art provides a clothes hanger having clamps with clamp plates modified by mounting a soft elastic (e.g., silicone rubber) pad upon the inner surface of each clamp plate such that the soft pads will make direct contact with the fabric of the clothes and apply substantially all of the clamp's force upon the fabric and upon each other.

Although radio frequency plastic welding, chemical (e.g., adhesive) bonding and other processes are generally able to firmly bond the soft pads to the hard plastic clamp plates, each of these processes is often prohibitively expensive for the manufacture of plastic hangers. The related art therefore attempts to inexpensively mount soft pads upon the hard plastic clamp plates such that when plate and pad are pressed together, a static friction bond is formed between mating surfaces of protrusions on the body and the joining-recesses in the pad. However, the related art is deficient in that during use, particularly during the insertion and removal of clothing, the moving fabric can catch on a perimeter edge of the soft pads and pull or "peel" the soft pad off of the clamp plate.

Accordingly, the hanger of related art is deficient in that a pad of the related art is very vulnerable to being removed from the clamp body of the related art by a force or forces applied by the clothing that is to be hung upon the hangers of the related art. Therefore, a need exists to reduce the vulnerability of a pad to a removal from the body by forces as described.

SUMMARY OF THE INVENTION

The present invention provides an improved clamp pad-body assembly that resists the separation of the clamp pad from the clamp body. An aspect of the invention provides an improved clamp, including: a body having a peripheral surface that has a height that is greater than the height of the exterior perimeter surface of the pad, and the exterior perimeter surface of the pad abuts the perimeter surface of a recess in the clamp body.

BRIEF DESCRIPTION OF THE DRAWINGS

To enable better understanding of the technique, principles and performance of the subject invention, exemplary embodiments are described with drawings.

FIG. 1*ci*, FIG. 1*cii*, and FIG. 1*ciii* are cross-sectional views depicting a time sequence of a second embodiment of the related art;

FIGS. 4*ai*, 4*aii*, 4*aiii* depict orthogonal views (top, side and front) of a second embodiment of the clamp pad-body assembly of the present invention.

DETAILED DESCRIPTION OF THE INVENTION

Figure 1A:
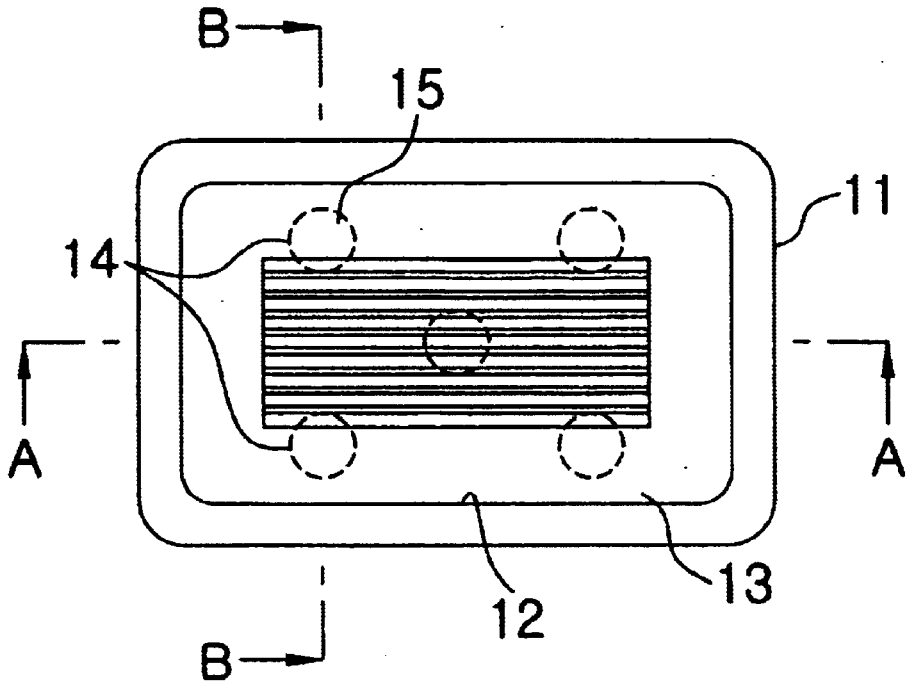
Fig. 1a Related Art
FIG. 1*a* is the top view of the clamp pad-body assembly of the related art.

FIG. 1*a* depicts a two-dimensional view of a typical related art configuration of a soft pad 3 having an exterior perimeter 12 attached to an underlying hard plastic clamp body 11, held together by static friction at the annular contacts 14 of protrusions (e.g., 15) and the corresponding joining-recesses in the soft pad 13.

Figure 1B:
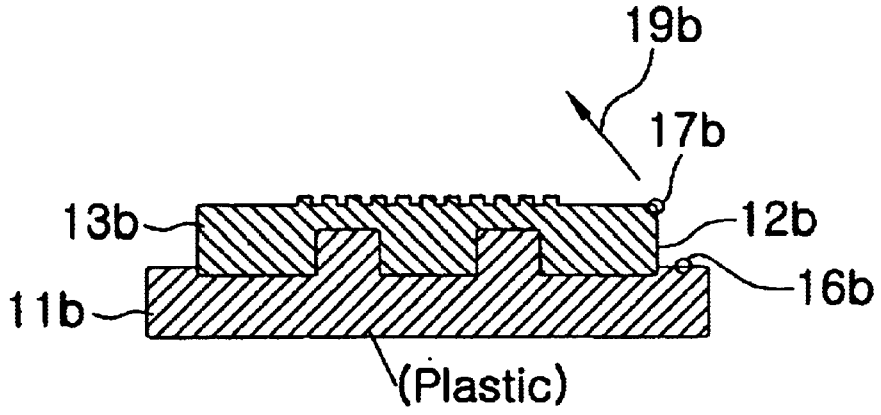
Fig. 1bi Related Art
FIG. 1*bi*, FIG. 1*bii*, and FIG. 1*biii* are cross-sectional views depicting a time sequence of a first embodiment of the related art.

FIG. 1*bi* depicts a cross-sectional view of a pad-body assembly (13*b*–11*b*) of the related art wherein a portion of the exterior perimeter surface 12*b* of the pad 13*b* extends above the peripheral surface 16*b* of the body 11*b* and perpendicular to the body 11*b*, such that an article of clothing may rub or catch on the exterior perimeter surface 12*b* and/or a corner 17*b* at the top of the exterior perimeter surface 12*b*, thereby applying forces (e.g., initial force 19*b*) that pulls the pad 13*b* away from (see FIG. 1*bii*) and ultimately off of (see FIG. 1*biii*) the body 11*b*.

As depicted in FIG. 1*bii*, an initial force (e.g., 19*b*) applied by an article of clothing upon the exterior perimeter surface 12*b* and/or a corner 17*b* at the top of the exterior perimeter surface 12*b*, can deform and/or displace the pad 13*b* to such an extent that additional forces (e.g., 10*b*) may then be applied by the clothing to the lower peripheral edge 18*b*. Thus, the initial displacement of the pad 13*b* away from the body 11*b* creates a lever-affect that increases the effectiveness of the force 19*b* and/or additional forces (e.g, 10*b*) to pull or "peel" the pad 13*b* completely off of the body 11*b*; thereby resulting in the complete removal of the pad 13*b* from the base 11*b*, as depicted in FIG. 1*biii*.

FIGS. 1*ci*, 1*cii*, 1*ciii* illustrate a time sequence illustrating that a force (e.g., a frictionally coupled force) that is applied by an article of clothing to a pad 13*c* of the related art having an angled peripheral surface 12*c* and being attached to a body 11*c* of the related art can displace (see FIG. 1*ci*) and then deform (see FIG. 1*cii*) and ultimately completely remove (see FIG. 1*ciii*) the pad 13*c* off of the body 11*c*. FIG. 1*ci* and FIG. 1*cii* illustrates that once the lower perimeter edge 18*c* of the pad 13*c* is displaced such that the perimeter edge 18*c* is raised above the top peripheral surface 16*c* of the body 1*c*, the force (e.g., 19*c*) may act upon that perimeter edge, thereby causing the angled peripheral surface 12*c* of the pad 13*c* to deform, thus further displacing the perimeter edge 18*c* away from the peripheral surface 6*c* and creating a lever effect that increases the effectiveness of a force (e.g., 19*c*) to pull or "peel" the pad 13*c* completely off of the body 11*c*.

Figure 2A:
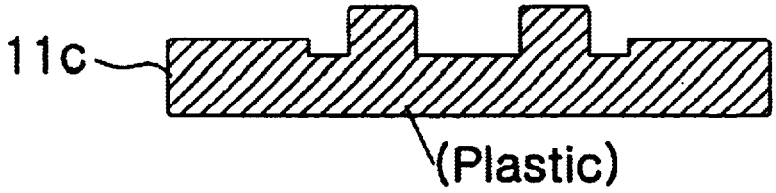
FIG. 2*a* depicts a front view of an embodiment of a hanger in accordance with the present invention.
Figure 2A:
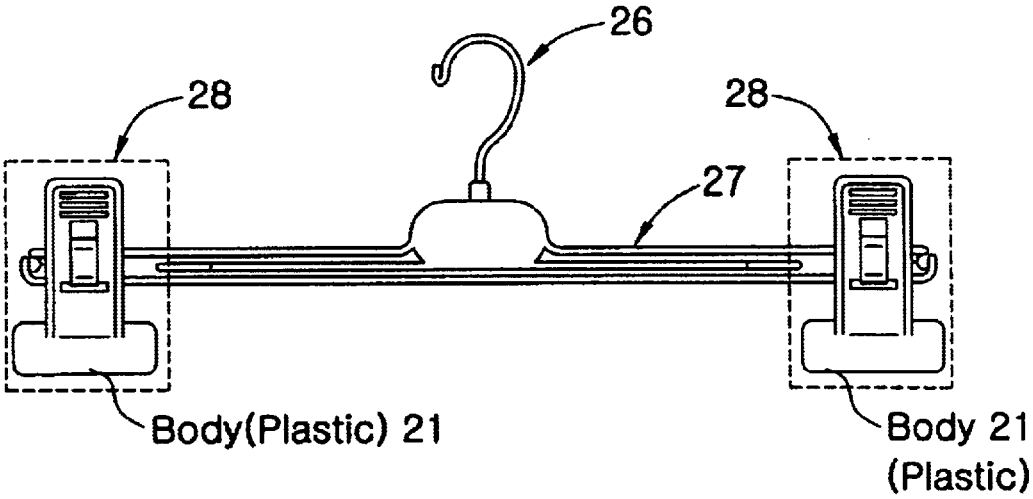

FIG. 2*a* depicts an inventive hanger including a question-mark-shaped hook 26, a horizontally disposed beam 27 coupled to the hook 26, and two clamps 28 disposed at the ends of the beam 27 and that each include a pair of clamp bodies 21 attached to clamp pads in accordance with embodiments of the invention. The inventive clothes hanger may be used for hanging pants, skirts and dresses, etc., that are held by and suspended from the two clamping devices 28 (clamps similar to clothes pins) including clamp bodies 21, disposed at the ends of the horizontal beam 27. The question-mark-shaped hook 26 enables the hanger to be suspended from a bar or a rack. The hook 26 and the beam 27 may be made of hard plastic, metal, fiberglass, or any other rigid material.

Figure 2B:
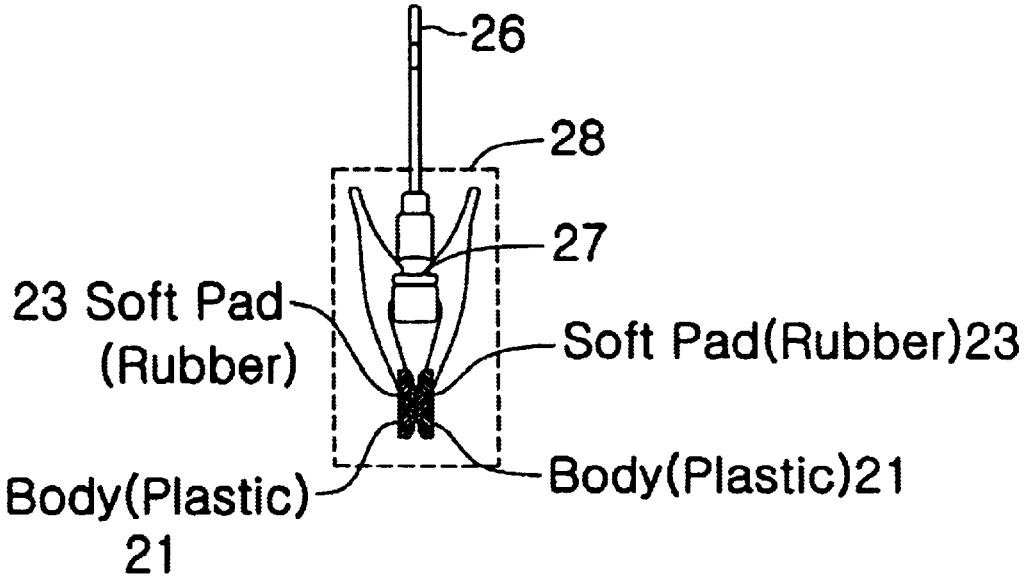
FIG. 2*b* depicts the hanger of FIG. 2*a* from an end-perspective showing the two pad-body (23–21) assemblies the clamps 28 in accordance with embodiments of the present invention.

FIG. 2*b* depicts the hanger of FIG. 2*a* from a side-view showing the two pad-body (23–21) assemblies on a clamp 28 disposed at the end of a beam 27, in accordance with embodiments of the invention. Each clamp has two soft pads mounted on clamp bodies for clamping onto and holding the fabric of the clothes. The soft pads on each clamp are disposed opposite each other such that when fabric is placed between them, the pads may be clamped together to apply a pinching force upon the fabric and upon each other, thereby securing the clothes to the hanger.

Figure 3A:
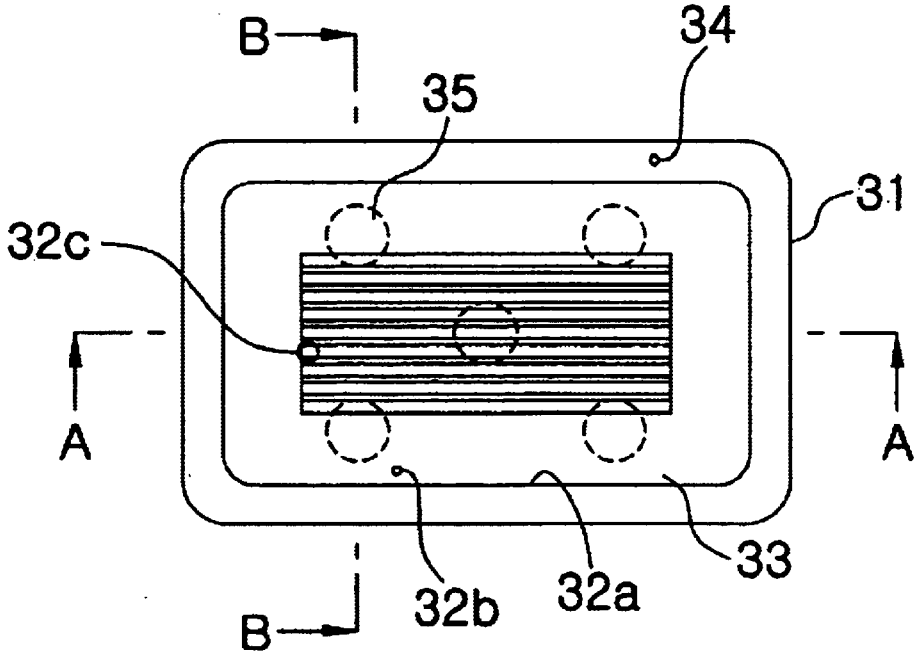
FIGS. 3*ai*, 3*aii*, 3*aiii* depict orthogonal views (top, side and front) of a first embodiment of the clamp pad-body assembly of the present invention.
Figure 3B:
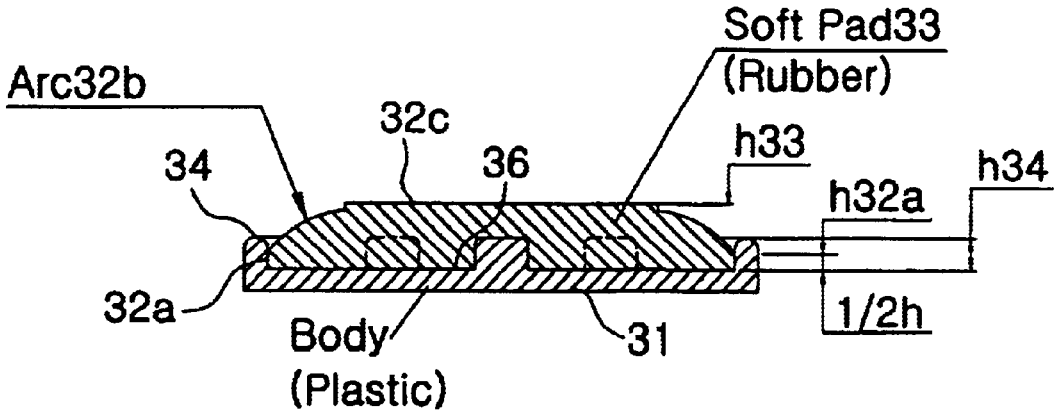
FIGS. 3*b*, and 3*c* depict a cross-sectional views of the assembly depicted in FIG. 3*ai*.
Figure 3C:
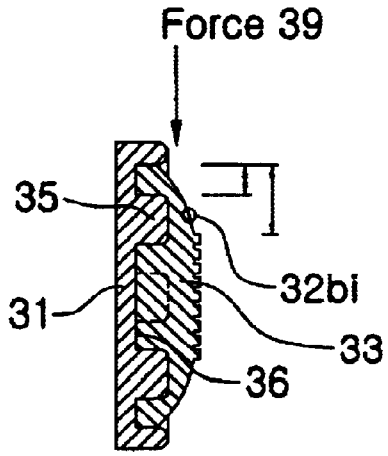

FIGS. 3*ai*, 3*aii*, 3*aiii*, 3*b*, and 3*c* depict a first embodiment of a clamp pad-body assembly in accordance with embodiments of the invention wherein a soft pad 33, having an exterior perimeter surface 32*a* and a curved (e.g., arc-shaped) top peripheral surface 32*b*, is seated within a joining-recess 36 set into the body 31. While the curved peripheral surface 32*b* is depicted in FIGS. 3*b* and 3*c* as being a convex arc in cross-section, in alternative embodiments the curved peripheral surface 32*b* may be concave, and may include parabolic, elliptic, or any of many other continuously curved shapes, in cross-section. The peripheral surface 32*b* is smooth so that it can reduce friction forces and also convert contact forces incident from a variety of angles (e.g., a force 39 incident downwardly directly upon chamferred surface 32*bi* of the pad 33) into forces having a component perpendicular to the base of the pad (the flat bottom of the pad in contact with the base of the body-recess 36), such that incident forces applied by clothing to the chamferred peripheral surface 32*b* tend to press and keep the pad 33 in abutting contact with the body 31. The pad in the pad-body assembly of FIGS. 3*ai*, 3*b*, 3*c* has been impaled upon a plurality of approximately cylindrical protrusions 35 extending from the base of the body-recess 36 in the body 31.

FIGS. 4*ai*, 4*aii*, 4*aiii*, 4*b*, and 4*c* depict a second embodiment of a clamp pad-body assembly in accordance with embodiments of the invention wherein a soft pad 43 having a vertical exterior perimeter surface 42*a* and a chamferred peripheral surface 42*b* is seated within a body-recess 46 set into the body 41. The chamferred peripheral surface 42*b* has four segments (e.g., 42*bi*, 43*bii*, 42*biii*, 42*biv*) in the case of a rectangular (i.e., four-sided) pad-body assembly.

The exterior perimeter surface of alternative embodiments of the pad-body assembly of the present invention may have three, four, or more distinct sides (or segments) or may be circular, oval, kidney-shaped, or otherwise symmetric or asymmetric. Each segment of the chamferred peripheral surface 42*b* can convert forces incident from a variety of angles (e.g., a force 49 incident downwardly directly upon chamferred surface 42*bi* of the pad 43) into forces having a component perpendicular to the base of the pad (the flat bottom of the pad in contact with the base of the body-recess 46), such that incident forces applied by clothing to the chamferred peripheral surface 42*b* tend to press and keep the pad 43 in contact with the body 41. The pad in the pad-body assembly of FIGS. 4*ai*, 4*b*, 4*c* has been impaled upon a plurality of approximately cylindrical protrusions 45 extending from the base of the body-recess 46 in the body 41.

Referring to two exemplary embodiments simultaneously, (i.e., depicted in FIGS. 3*ai*, 3*b*, and 3*c* and in FIGS. 4*ai*, 4*b*, and 4*c*): The exterior perimeter surface (32*a*, 42*a*) of the pad in the embodiments of the invention is thicker than the sharp perimeter edge 18*c* of the related art pad 13*c* of FIG. 1*ci*. This greater thickness imparts to the exterior perimeter of the invention's pad (33, 43) a greater resistance against deformation than the related art pad that has an angled peripheral surface terminating at a sharp perimeter edge (e.g. 18*c* in FIG. 1*ci*). Locating the exterior perimeter surface (32*a*, 42*a*) of the pad below the peripheral surface (34, 44) of the body shields the exterior perimeter surface (32*a*, 42*a*) of the pad from forces (e.g., friction forces or a fabric seam) that would otherwise be applied to it by clothing. Additionally, the height of peripheral surface h34, h44 (in the exemplary embodiments) being about twice the height of the exterior perimeter surface (h32*a*, h42*a*) of the pad, provides a safety-margin of space (h34 minus h32*a*, h44 minus h42*a*) for a displaced exterior perimeter surface (32*a*, 42*a*) of the pad to occupy while still being shielded from forces (e.g., friction forces or a fabric seam) that would otherwise be applied to it by clothing if unshielded as in the related art. Thus, even if the exterior peripheral surface (32*a*, 42*a*) is displaced a distance about equal to its own height (e.g., by a force applied by clothing), the portion (h34 minus h32*a*, h44 minus h42*a*) of the height (h34, h44) of the peripheral surface (34, 44) above the normal height of the exterior perimeter surface (h32*a*, h42*a*) will shield the exterior peripheral surface (32*a*, 42*a*) from exposure to additional forces applied by clothing. The safety-margin provided by the peripheral surface (34, 44) of the body may be increased by increasing the ratio of the height of the peripheral surface (h34, h44) relative to the height of the exterior peripheral surface (h32*a*, h42*a*). The peripheral surface (34, 44) of the body (31, 41) may have many different topologies in alternative embodiments all having the same given height (e.g., h32, h42). Optimally, the highest part of the cross-section of the body (other than the protrusions 35, 45) will be near to or adjacent to the exterior perimeter surface (h32*a*, h42*a*) of the pad, to provide maximal shielding of the pad and protection from contact with clothing.

Figure 4B:
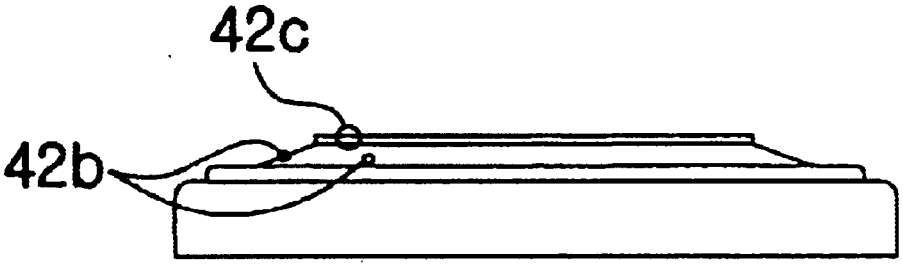
FIGS. 4*b*, and 4*c* depict cross-sectional views of the assembly depicted in FIG. 4*ai*.
Figure 4B:
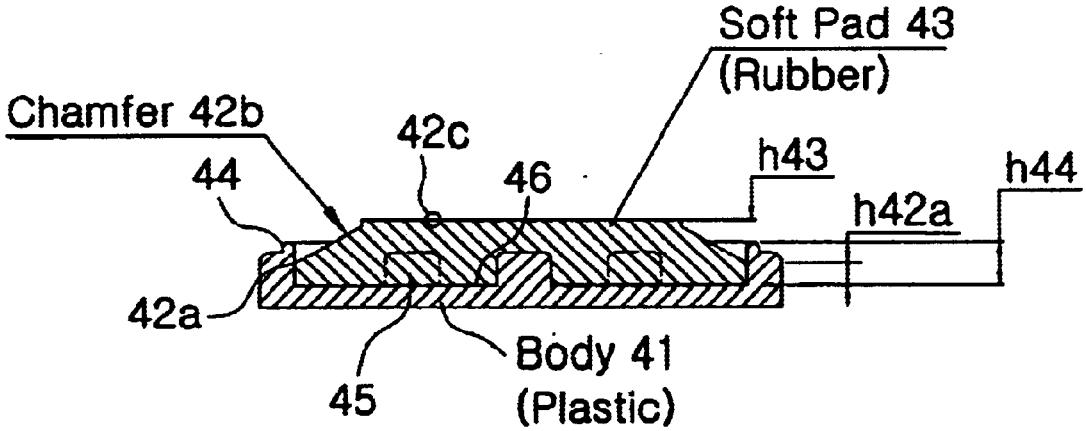
Figure 4C:
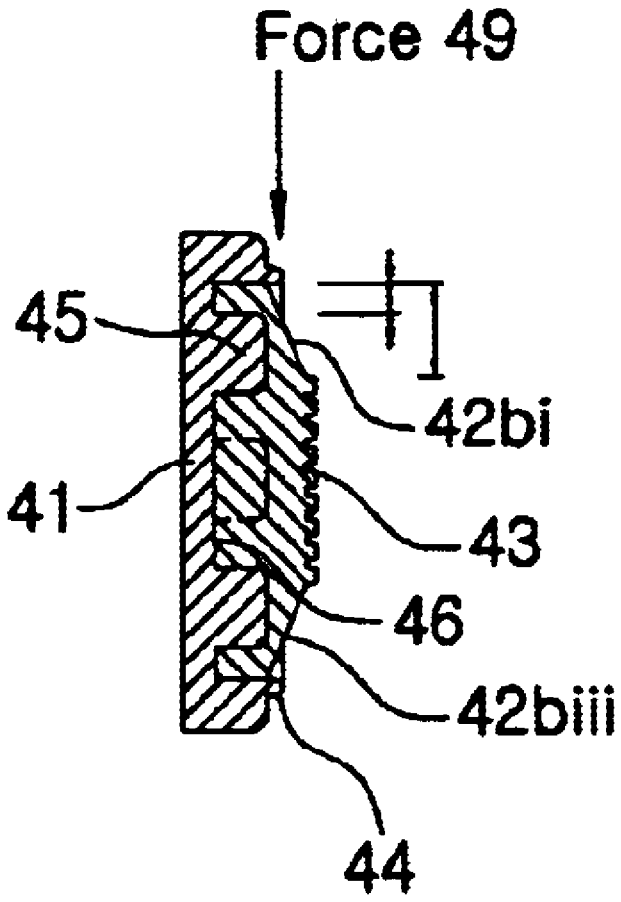

The topology of the body's peripheral surface 44 in the embodiment depicted in FIGS. 4*b* and 4*c* provides a higher surface closer to the exterior perimeter surface 42*a* of the pad than the embodiment depicted in FIGS. 3*b* and 3*c*. Alternative embodiments of the invention may provide a body-recess having a slanted or curved or slotted perimeter surface, such that the peripheral surface (34, 44) of the body will lean over or extend cantilever over the exterior perimeter surface (h32*a*, h42*a*) of the pad.

The thickness of the exterior perimeter surface (h32*a*, h42*a*) of the pad may also have a functional relationship with the height of the peripheral surface (h34, h44) of the body and with the thickness (i.e., height of the perimeter of the central surface h33, h43) of the pad, and with the location and height of the cylindrical protrusions. The body (31, 41) has a height, (i.e., the height of the peripheral surface h34, h44 of the body) that is greater than the height (e.g., about twice the height) of the exterior perimeter surface (h32*a* h42*a*) of the exemplary pad (33, 43). The exterior perimeter surface (32*a*, 42*a*) of the exemplary pad (33, 43) has a height that is between about one half to one sixth (e.g., one about on-forth) of the thickness (h33, h43) of the pad (i.e., the height of the perimeter of the central surface 32*c*, 42*c* of the pad 33, 43). The thicker the pad (33, 43) is, the more torque will be generated, by a force (e.g, 39, 49) applied (parallel to the base of the pad) by clothing vertically upon the pad, measured about the free end of a protrusion (35, 45) extending from the body-recess (36, 46). Such torque could deform the pad and raise the exterior perimeter surface (32*a*, 42*a*) partly out of the body-recess. The taller the protrusions (35, 45) are, the smaller the magnitude of the torque that will be developed on the pad by the forces applied (parallel to the base of the pad) by the clothing. Therefore, the height of the protrusions (35, 45) should be about the same, or greater than, the height of the peripheral surface (h34, h44) of the body (31, 41).

The first and second exemplary embodiments of the invention include a central surface (32*c*, 42*c*) of the pad that has a non-smooth texture which contrasts with the smooth surface of the peripheral surface (32*b*, 42*b*) of the pad. The non-smooth texture of the central surface (32*c*, 42*c*) of the pad is optional, since with enough force applied by the clamp, even a pad with only a smooth surface may securely pinch and hold clothing. In embodiments having a central surface (32*c*, 42*c*) of the pad having a non-smooth texture, the texture may be formed by grooves on the surface of the pad. Such grooves may be parallel and straight as depicted in FIGS. *3ai* and 4*ai*, or, alternatively the grooves may be cross-hatched, or parallel with curves (e.g., to simulate a pattern of typical finger prints on human finger tips). And alternatively the texture of the central surface (32*c*, 42*c*) of the pad may be simply a "rough" surface, such as would result by etching or by rubbing an abrasive upon a smooth central surface of the pad, or by other known methods of roughening a surface.

Additionally, because a force (e.g., 39, 49) is likely to be applied by clothing to the upper surface (32*b* 42*bi*) of the pad or to the adjacent perimeter of the central surface (32*c*, 42*c*) of the pad, a reduction of and/or a resistance to the torque developed in that area of the pad is highly desirable. Accordingly, an aspect of the invention provides that the protrusions (35, 45) nearest to the exterior perimeter surface (32*a*, 42*a*) of the pad, should be placed as near as practicable to that exterior perimeter surface (32*a*, 42*a*) while having a height about the same, or greater than, the height of the peripheral surface (h34, h44) of the body (31, 41).

Because of the different topologies of the curved peripheral surface 32*b* (in the exemplary embodiment of FIGS. 3*ai*, 3*b*, 3*c*) compared to the chamferred peripheral surface 42*b* (in the exemplary embodiment of FIGS. 4*ai*, 4*b*, 4*c*), the protrusions (35) may be and are placed nearer to the exterior perimeter surface 32*a* in the exemplary embodiment of FIGS. 3*a*, 3*b*, 3*c*. The placement of the protrusions (35, 45) so as to minimize the space between the protrusions (35, 45) and the exterior perimeter surface (32*a*, 42*a*) of the pad minimizes the torque developed near the exterior perimeter surface (32*a*, 42*a*) of the pad. Further, the torque generated by a force (e.g., 39, 49) applied to the pad is more strongly resisted by the perimeter surface of the body-recess (abutting the exterior perimeter surface of the pad 32*a*) when the space between the protrusions (35, 45) and the exterior perimeter surface (32*a*, 42*a*) of the pad is minimized, and when the pad is somewhat oversized so that it is tightly inserted within the body-recess.

The heights of the approximately cylindrical male joining protrusions (35, 45) nearest to the exterior perimeter surface (32*a*, 42*a*) of the exemplary pad (33, 43) are about equal to or greater than the height (h34, h44) of the peripheral surface (34, 44) of the body (33, 43). In alternative embodiments, some protrusions extending from the base of the body-recess may have different heights than others, and some or all protrusions may have a height equal or almost equal to the height of the pad (h33, h43).

Although the diagrams (i.e., FIGS. 3*ai*, 3*b*, 3*c*, and 4*ai*, 4*b*, 4*c*) depict embodiments of the inventive pad-body assembly being held together by cylindrical protrusions of the body in annular or cylindrical contact with cylindrical joining-recesses of the pad, other joining methods may be substituted by persons skilled in the art. For example, protrusions extending out of the bottom of the soft rubber pad may be inserted into complementary joining-recesses formed in the body, thereby creating a similar static friction bond. Also, where protrusions and joining-recesses are used, persons in the art would understand that such need not have perfect geometrically cylindrical surfaces. In practice, because of the typical requirements and effects of well known manufacturing techniques (e.g., injection molding) that may be most convenient and inexpensive, the approximately cylindrical exterior surface of at least one of the approximately cylindrical male protrusions may actually be shaped approximately conical rather than as a true cylinder of uniform diameter, such that the end of the protrusion furthest from the hard planar surface has a somewhat smaller diameter than the base of the protrusion in contact with a circular area of the hard planar surface. Similarly, the approximately cylindrical interior surface of at least one of the approximately cylindrical female receptacles may be shaped approximately conical rather than as a true cylinder of uniform diameter, such that the end of the receptacle furthest from the soft planar surface has a smaller diameter than the opening of the receptacle in annular contact with the soft planar surface. Alternatively, the male protrusions may include a barb (e.g., shaped like a cone stacked on a column), and the joining-recesses (35, 45) of the pad may include a complementary barb-shaped (e.g., cone-on-column-shaped) recess, such that once the protrusions are pressed into joining recesses, the pad and the body will be firmly locked together.

While the above description relates merely to exemplary embodiments of the invention, it is intended that all equivalent variations or modifications deriving from the invention as disclosed herein shall be included in the subject claims.

What is claimed is:

1. A hanger comprising:

a clamp including;

a body having a face with a recess located thereon, said body further having a peripheral surface within said recess; and a pad attached in said recess and having a peripheral edge that abuts said peripheral surface;

wherein a portion of the peripheral edge of the pad that abuts the peripheral surface of the recess has a height that is less than the height of the peripheral surface.

2. The hanger of claim 1, wherein a central surface of the pad has a height that is greater than the height of the peripheral surface of the body.

3. The hanger of claim 2, wherein the height of the peripheral surface of the body is greater than the height of the exterior perimeter surface of the pad and wherein the height of the exterior perimeter surface of the pad is at least one quarter of the height of the peripheral surface of the body.

4. The hanger of claim 2, wherein the height of the peripheral surface of the body is greater than the height of the exterior perimeter surface of the pad.

5. The hanger of claim 4, wherein the height of the peripheral surface of the body is at least twice the height of the exterior perimeter surface of the pad.

6. The hanger of claim 4, wherein the height of the central surface of the pad is at least twice the height of the exterior perimeter surface of the pad.

7. The hanger of claim 4, wherein the height of the central surface of the pad is less than or equal to twice the height of the peripheral surface of the body.

8. The hanger of claim 2, wherein the central surface of the pad has a non-smooth texture.

9. The hanger of claim 8, wherein the texture is rough.

10. The hanger of claim 8, wherein the texture is characterized by a plurality of grooves in a second soft planar surface.

11. The hanger of claim 10, wherein the grooves are parallel.

12. The hanger of claim 11, wherein the parallel grooves have curves.

13. The hanger of claim 8 wherein the peripheral surface of the pad is smooth.

14. The hanger of claim 13 wherein the peripheral surface of the pad has a band width, said band width being between a perimeter of the central surface of the pad and the exterior perimeter surface of the pad, that is greater than the height of the peripheral surface of the body.

15. The hanger of claim 14 wherein the peripheral surface of the pad has a chamferred topology.

16. The hanger of claim 14 wherein the peripheral surface of the pad has a convex, topology.

17. An assembly comprising:

a clamp including;

a body having a peripheral surface that has a height and having a recess that has a perimeter surface; and a pad attached to the recess and having a portion of an exterior perimeter surface that abuts the perimeter surface of the recess;

wherein the height of the peripheral surface of the body extends above the height of the abutting exterior perimeter surface of the pad.

18. A hanger comprising:

a clamp including;

a body having a recess therein, wherein said recess has a first perimeter; and a pad having a second perimeter within the recess, wherein said second perimeter abuts said first perimeter, wherein said first perimeter has a height greater than a height of said second perimeter, where said second perimeter abuts said first perimeter.

19. A hanger comprising:

a clamp including;

a body having a recess therein; and a pad having a perimeter within the recess, wherein said recess has a perimeter with a height greater than a height of the perimeter of said pad, wherein the recess further includes a plurality of approximately cylindrical male protrusions each having an approximately cylindrical exterior surface, and wherein the pad further includes a plurality of approximately cylindrical female receptacles having an approximately cylindrical interior surface and being arranged complementary to the arrangement of the plurality of protrusions such that the plurality of protrusions and the plurality of receptacles are coaxially joined such that the exterior surface of each protrusion is in annular contact with an interior surface of a receptacle.

* * * * *